US006541427B1

(12) United States Patent
Dresel

(10) Patent No.: US 6,541,427 B1
(45) Date of Patent: Apr. 1, 2003

(54) LUBRICANT FOR MAINTENANCE-FREE CARDAN SHAFTS

(75) Inventor: Wilfried Hermann Dresel, Ludwigshafen (DE)

(73) Assignees: FUCHS Europe Schmierstoffe GmbH & Co. KG, Mannheim (DE); Spicer Gelenkwellenbau GmbH & Co. KG, Essen (DE)

( * ) Notice: Subject to any disclaimer, the term of this patent is extended or adjusted under 35 U.S.C. 154(b) by 0 days.

(21) Appl. No.: 09/102,390

(22) Filed: Jun. 22, 1998

(30) Foreign Application Priority Data

Jun. 20, 1997 (DE) ..... 197 26 127
Apr. 17, 1998 (DE) ..... 198 17 055

(51) Int. Cl.[7] ..... C10M 135/18; C10M 135/36; C10M 117/00

(52) U.S. Cl. ..... 508/272; 508/363; 508/379; 508/380; 508/514; 508/539; 508/551

(58) Field of Search ..... 508/198, 272, 508/363, 379, 380, 514, 539, 551

(56) References Cited

U.S. PATENT DOCUMENTS

| | | | | |
|---|---|---|---|---|
| 3,533,943 A | | 10/1970 | Papayannopoulos | |
| 4,897,210 A | | 1/1990 | Newsoroff | |
| 5,043,085 A | | 8/1991 | Kinoshita et al. | |
| 5,670,461 A | | 9/1997 | Schreiber et al. | |
| 5,672,571 A | * | 9/1997 | Hatakeyama | 508/321 |
| 5,922,654 A | * | 7/1999 | Yamazaki | 508/364 |

FOREIGN PATENT DOCUMENTS

| | | | |
|---|---|---|---|
| DE | 195 30 504 | | 3/1996 |
| EP | 0 592 956 | | 4/1994 |
| EP | 0 761 805 | | 3/1997 |
| FR | 2572089 | * | 4/1987 |
| WO | WO94/11470 | | 5/1994 |
| WO | WO97/15644 | | 5/1997 |

* cited by examiner

*Primary Examiner*—Cephia D. Toomer
(74) *Attorney, Agent, or Firm*—Kenyon & Kenyon

(57) ABSTRACT

The present invention relates to a lubricant for service-free cardan shafts comprising a base selected from the group consisting of a naphthenic solvent and a paraffinic solvent; a thickener selected from the group consisting of lithium salt, lithium soap, and amides of aromatic dicarboxylic acids; at least one flux oil; and an additive selected from the group consisting of molybdenum dithiocarbamate, zinc dithiocarbamate, bismuth dithiocarbamate, molybdenum dithiophosphate, zinc dithiophosphate, and bismuth dithiophosphate, in combination with thiadiazole.

22 Claims, 1 Drawing Sheet

LUBRICANT FOR MAINTENANCE-FREE CARDAN SHAFTS

FIELD OF THE INVENTION

The present invention relates to a lubricant for service-free cardan shafts.

RELATED TECHNOLOGY

It is known that lubricating grease can be used in homokinetic joints at high temperatures. produced at low cost and can effectuate a longer lifetime of homokinetic joints when used as a permanent solid lubricant filing.

Lubricating grease in German Offenlegungsschrift 195 30 504 contains mineral and/or synthetic oils as the base, urea compounds as thickeners and molybdenum sulfide as dispersed solid lubricant. Additionally, the lubricating grease involves graphite, polytetrafluoroethylene and at least one organic molybdenum compound. International patent application WO 97/03152 uses molybdenum disulfide, zinc naphthenate and one or more metal dithiophosphates as a friction reducing additive mixture in lubricant oils based on a mineral and/or synthetic oil. International patent application WO 94/11470 uses a lubricant grease containing lithium soap to which dithiocarbamates or dithiopliosphates of molybdenum are added in mixture with dithiocarbamates or dithiophosphates of bismuth, lead, antimony and other heavy metals in the presence of various organic sulfur compounds, including thiadiazole. The lubricant oils described also contain organic phosphates. phosphines, phosphonates or phosphates; such compounds are considered critical for the improvement in properties of the lubricant.

Notwithstanding their suitable usefulness in homokinetic joints, such lubricants do not yield good results when used in certain utility vehicle parts. particularly universal joint fittings.

Thus, there is a need for a lubricant for utility vehicle parts such that the lubricant's properties improve running performance, are economically manufactured and are environmentally safe. More particularly. There is a need for a lubricant providing these qualities for universal joints fittings for heavy utility vehicles.

SUMMARY OF THE INVENTION

The above and other objects of the present invention are achieved by a lubricant composition comprising.

a base selected from the group consisting of a naphthenic solvent and a paraffinic solvent:

a thickener selected from the group consisting of a lithium salt, a lithium soap, and an amide of aromatic dicarboxylic acid;

at least one flux oil, and an additive selected from the group consisting of molybdenum-, zinc-, bismuth dithiocarbamate or of a molybdenum-, zinc- or bismuth dithiophosphate in combination with a thiadiazole.

Other antioxidants, corrosion inhibitors and high-pressure additives conventionally used in lubricants can be added to the above lubricant composition.

The lubricant composition according to this invention provides improved running time, less manufacturing costs and increased environmental safety for parts in heavy utility vehicles. More particularly, the lubricant composition according to this invention provides the improvements mentioned above for universal joints and cardan shafts.

The base of the lubricant according to this invention may be comprised of mineral oils and/or synthetic hydrocarbon oils. Preferably, the base is a naphthenic solvent raffinate obtained by combining a naphthenic base mineral oil with a synthetic hydrocarbon in an about 1:3 to about 1:5 ratio. Also preferable, the base is a paraffinic solvent raffinate, obtained by mixing a paraffin-base mineral oil with a synthetic hydrocarbon oil in an about 1:3 to about 1:5 ratio, having a viscosity of about 100 to about 150 centistokes at about 40° C.

Example embodiments of the present invention may provide a lubricant composition including a base, the base being at least one of a naphthenic solvent, a paraffinic solvent, a naphthenic solvent raffinate, a paraffinic solvent raffinate, a thickener, the thickener being at least one of a lithium soap, a lithium salt and an amide, at least one flux oil, and an additive, the additive selected from the group consisting of molybdenum dithiophosphate, molybdenum dithiocarbamates, zinc in combination with thiadiazole, and bismuth in combination with thiadiazole.

The thickener of the lubricant according to this invention may be comprised of lithium salt, lithium soap, or amide. The thickener may be lithium salts of aliphatic, cycloaliphatic or aromatic, mono- or dicarboxylic acids and lithium borate. Preferably, according to this invention, the thickener can be a lithium salt added to the base of the lubricant in an amount of about 5 to about 20 percent by weight, based on the amount of the base of the lubricant.

The thickener of the lubricant according to this invention can also be a lithium soap thickener derived from a saturated or unsaturated aliphatic, mono- or dicarboxylic acid with 10 to 24 carbon atoms, preferably 16 to 18 carbon atoms. Complex lithium soaps formed from mixtures of various fatty acids and other acids are preferred. Mixtures of the lithium salt of 12-hydroxystearic acid with lithium salts of azelaic acid, sebacic acid or boric acid in particular have already been used widely as thickeners for lubricants because they can be used at higher temperatures than simple lithium soaps.

Finally, amides of aromatic dicarboxylic acids, in particular the amides of terephthalic acid which are known as terephthalamates especially the octadecylamide of terephthalic acid can be used with good results as high temperature thickeners.

The "flux oil," e.g. a synthetic viscosity adjusting component of the lubricant according to this invention may be one or more flux oils in which other additives may be dissolved. The flux oil, added to the base of the lubricant according to this invention, can aid in achieving the flattest possible viscosity-temperature curve during operation. The flux oil can be olefin copolymers, polybutenes, polyol esters, poly-α-olefins, perfluoropolyethers, polysiloxanes and hydrogenated diene-styrene copolymers. The flux oil can be added to the grease base in an amount of about 2 to about 40 percent by weight, based on the total amount of the lubricant.

The additives of the lubricant according to this invention can be used to stabilize the lubricant to withstand high thermal and mechanical stresses occurring, for example, in the trunnion gear bearings. The additives can be antioxidants including sterically hindered phenols and amines, e.g., phenyl-αa-naphthylamines.

The above-mentioned properties of the lubricant according to this invention may also be achieved because the lubricant contains dithiocarbamates or dithiophosphates of molybdenum, zinc or bismuth in combination with a thiadiazole in addition to other additives. Molybdenum dithiophosphates and molybdenum dithiocarbamates have proven especially suitable. When such molybdenum compounds are used together with a 1-thia-3,4-diazole or its sulfur-bridged dimers, or thiadiazole derivates, the lubricant properties are permanently improved at both high temperature and high mechanical loads to such an extent that the original manufacturer's lubrication of a joint fitting may be sufficient to last the entire lifetime of the utility vehicle.

A further improvement can be achieved by adding a corrosion inhibitor such as N-acylsarcosine, or sarcosine derivative, and/or a high-pressure additive such as methylene-bis(dibutyidithiocarbamate) to the lubricant according to this invention. The total amount of additives is preferably in the range of about 2 to about 10 percent by weight, based on the total lubricant.

The lubricant according to this invention can be made by dissolving or suspending the lithium thickener, the lithium thickener being prepared by reacting lithium hydroxide with an aliphatic or aromatic mono- or dicarboxylic acid of an alkylsulfonic acid or boric acid,in the base and adding part of the additive, or high pressure additive to the flux oil. These two mixtures are then mixed together at an elevated temperature between 80° C. and 240° C. in a mixing or stirring apparatus. High-pressure homogenizers have proven especially suitable for production of the lubricant according to this invention with a uniform and homogeneous distribution of ingredients. The temperature-sensitive additives are added just before homogenizing.

Another embodiment of the present invention provides a lubricant for service-free cardan shafts comprising a base being about 53 percent by weight in the lubricant, having about 1.0 percent by weight arylcarboxylic acid, about 1.0 percent by weight alkylsulfonic acid, about 3.0 percent by weight aliphatic dicarboxylic acids with 6 to 10 carbon atoms, about 8.0 percent by weight aliphatic monocarboxylic acids with 12 to 22 carbon atoms or their glycerides, about 3.0 percent by weight lithium hydroxide, and about 43.0 percent by weight naphthenic solvent raffinate; a flux oil, being about 40 percent by weight in the lubricant, having about 6.0 percent by weight olefin copolymer, about 18.0 percent by weight polyol ester, and about 76.0 percent by weight poly-α-olefin; and an additive component, being about 7 percent by weight, having about 0.5 percent by weight amine antioxidant, about 0.5 percent by weight carboxylic acid alkanolamide, about 2.0 percent by weight molybdenum compound, about 1.0 percent by weight vegetable oil, about 1.0 percent by weight sarcosine derivative, and about 2.0 percent by weight thiadiazole derivative.

Another embodiment of the present invention provides a lubricant for service-free cardan shafts comprising a base being about 86 percent by weight in the lubricant, having about 2.0 percent by weight boric acid, about 14.0 percent by weight monocarboxylic acids with 12 to 22 carbons or their glycerides, about 1.0 percent by weight polycarboxylic acid, about 3.0 percent by weight lithium hydroxide, and about 66.0 percent by weight paraffinic solvent raffinate; a flux oil being about 7 percent by weight in the lubricant, having about 12.0 percent by weight olefin copolymer, about 36.0 percent by weight polyol ester, and about 52.0 percent by weight poly-α-olefin; and an additive component being about 7 percent by weight in the lubricant, having about 0.5 percent by weight amine antioxidant, about 0.5 percent by weight carboxylic acid alkanolamide, about 2.0 percent by weight molybdenum compound, about 1.0 percent by weight vegetable oil, about 1.0 percent by weight sarcosine derivative, and about 2.0 percent by weight thiadiazole derivative.

EXAMPLES

Figure 1:
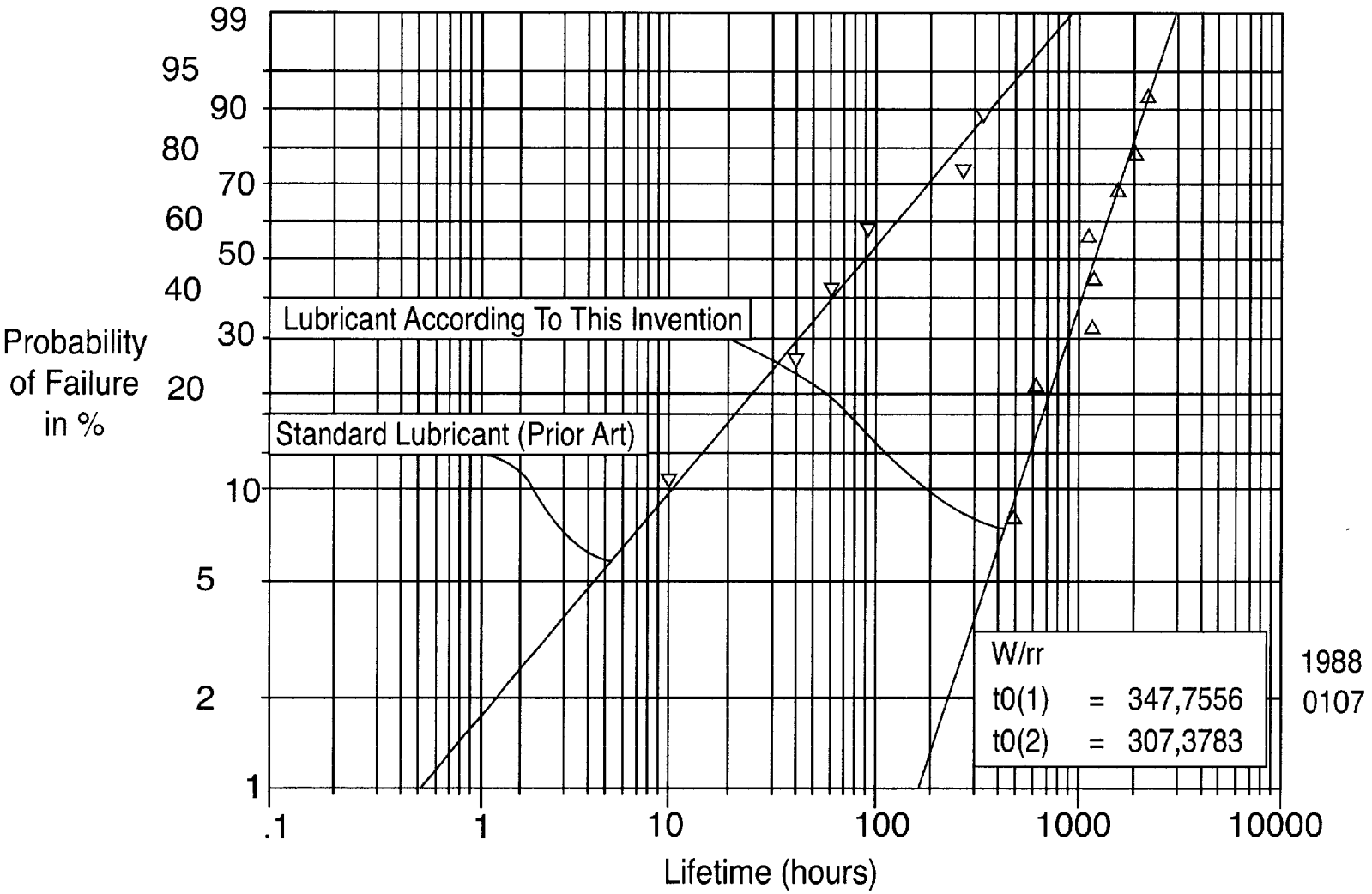
FIG. 1 is a graphic representation comparing one embodiment of the lubricant according to this invention and a standard lubricant.

The following examples show formulations of the lubricant according to this invention.

Example 1

One embodiment of the lubricant according to this invention was produced with the following general composition:

1Base Mixture 1.0 percent by weight arylcarboxylic acid 1.0 percent by weight alkylsulfonic acid 3.0 percent by weight aliphatic dicarboxylic acids with 6 to 10 carbon atoms 8.0 percent by weight aliphatic monocarboxylic acids with 12 to 22 carbon atoms or their glycerides 3.0 percent by weight lithium hydroxide 43.0 percent by weight naphthenic solvent raffinate This base mixture is contained in the lubricant according to this invention in an amount of about 53 percent by weight.

2. Flux Oil Mixture, e.g., Synthetic Viscosity Adjusting Components Mixture 6.0 percent by weight olefin copolymer 18.0 percent by weight polyol ester 76.0 percent by weight poly-α-olefine This flux oil mixture is present in the lubricant according to this invention in an amount of about 40 percent by weight.

3. Additives 0.5 percent by weight amine antioxidant 0.5 percent by weight carboxylic acid alkanolamide 2.0 percent by weight molybdenum compound 1.0 percent by weight vegetable oil 1.0 percent by weight sarcosine derivative 2.0 percent by weight thiadiazole derivative This additives mixture is present in the lubricant according to this invention in an amount of about 7 percent by weight.

Example 2

Another embodiment of the lubricant according to this invention was produced with the following general composition:

1. Base Mixture 2.0 percent by weight boric acid 14.0 percent by weight monocarboxylic acids with 12 to 22 carbons or their glycerides 1.0 percent by weight polycarboxylic acid 3.0 percent by weight lithium hydroxide 66.0 percent by weight paraffinic solvent raffinate This base mixture is contained in the lubricant according to this invention in the amount of about 86 percent by weight.

2. Flux Oil Mixture, e.g., Synthetic Viscosity Adjusting Components Mixture 12.0 percent by weight olefin copolymer 36.0 percent by weight polyol ester 52.0 percent by weight polya-αolefin This flux oil mixture is present in the lubricant according to this invention in the amount of about 7 percent by weight.

3. Additives 0.5 percent by weight amine antioxidant 0.5 percent by weight carboxylic acid alkanolamide 2.0 percent by weight molybdenum compound 1.0 percent by weight vegetable oil 1.0 percent by weight sarcosine derivative 2.0 percent by weight thiadiazole derivative This additives mixture is present in the lubricant according to this invention in the amount of about 7 percent by weight.

Example 3

Known Standard Lubricant

To evaluate the performance of the lubricants according to this invention, the lubricant according to the formulation in Example 1 was subjected to a lifetime failure test on universal joints. Eight universal joints with the lubricant according to Example 1 of this invention were compared with six universal joints using a standard lubricant with the following composition:

1. Base Mixture 2.0 percent by weight boric acid 14.0 percent by weight monocarboxylic acids with 12 to 22 carbon atoms or their glycerides 1.0 percent by weight polycarboxylic acid 3.0 percent by weight lithium hydroxide 66.0 percent by weight paraffinic solvent raffinate This base mixture is contained in the standard lubricant in the amount of about 86 percent by weight 2. Flux Oil 5.0 percent by weight polyol ester This flux oil is present in the standard lubricant in the amount of about 5 percent by weight.

3. Additives 0.5 percent by weight amine antioxidant 0.7 percent by weight carboxylic acid alkanolamide 1.0 percent by weight imidazoline derivative 1.0 percent by weight vegetable oil 0.5 percent by weight phenolic antioxidant 1.0 percent by weight thiadiazole derivative 2.5 percent by weight zinc dialkyl dithiophosphate 1.5 percent by weight zinc naphthenate This mixture of additives is present in the standard lubricant in the amount of about 9 percent by weight.

In comparison with the standard lubricant defined above, the lubricant according to Example 1 of this invention yielded a definitely improved lifetime when using the lubricant according to this invention in analysis of the individual lifetime values by means of the Weibull distribution (VDA: "Qualitatskontrolle der Automobilindustrie: Zuverl ässigkeitssicherung bei Automobilherstellern und Lieferanten, Verfahren und Beispiele," (Quality Control in the Automotive Industry: Reliability Assurance by Automotive Manufacturers and Suppliers, Methods and Examples), Association of the Automotive Industry (VDA). Westendstrasse 61, Frankfurt am Main, 1976). The universal joints were exposed to an ambient temperature of about 80° in carrying out the test. Exceeding an outside temperature of about 100° C., the standard lubricant measured at the bottom of the bearing bushing of the universal joint fittings of the universal joints was interpreted as a failure. When using the lubricant according to this invention, much higher B10 and B63.2 values were obtained.

TABLE 1

| | Weibull distribution | |
|---|---|---|
| | Lubricant according to this invention | Standard lubricant |
| Number of joints tested | 8 | 6 |
| B10 (h) | 868 | 316 |
| B63.2 (h) | 1,887 | 447 |
| Correlation | 0.95 | 0.98 |
| Failure-free time (h) | 348 | 307 |

The B10 value for the tested joints here describes the lifetime at which about 90% of the joints had not yet failed. Similarly, the B63.2 value describes the lifetime at which about 36.8% of the universal joints had not yet failed.

FIG. 1 shows a graphic representation of this experiment. It can be seen that the running time is much longer when using the lubricant according to this invention than when using the standard lubricant, and the failure-free time according to the table must be added to this. FIG. 1 shows this again as tO in the box at the lower right.

What is claimed is:

1. A lubricant composition comprising:

a base selected from the group consisting of a naphthenic solvent and a paraffinic solvent or mixture thereof;

a thickener selected from the group consisting of lithium soap, lithium salt, and amides of aromatic dicarboxylic acids;

at least one flux oil;

an additive selected from the group consisting of molybdenum-, zinc- or bismuth dithiocarbamate and of a molybdenum-, zinc- or bismuth dithiophosphate in combination with a thiadiazole; and octadecylamide of terephthalic.

2. A lubricant for maintenance-free cardan shafts comprising:

a base being about 53 percent by weight in the lubricant, having about 1.0 percent by weight arylcarboxylic acid, about 1.0 percent by weight alkylsulfonic acid, about 3.0 percent by weight aliphatic dicarboxylic acids with 6 to 10 carbon atoms, about 8.0 percent by weight aliphatic monocarboxylic acids with 12 to 22 carbon atoms or their glycerides, about 3.0 percent by weight lithium hydroxide, and about 43.0 percent by weight naphthenic solvent raffinate;

a synthetic viscosity adjusting component, being about 40 percent by weight in the lubricant, having about 6.0 percent by weight olefin copolymer, about 18.0 percent by weight polyol ester, and about 76.0 percent by weight poly-α-olefine; and an additive component, being about 7 percent by weight in the lubricant, having about 0.5 percent by weight amine antioxidant, about 0.5 percent by weight carboxylic acid alkanolamide, about 2.0 percent by weight molybdenum compound, about 1.0 percent by weight vegetable oil, about 1.0 percent by weight sarcosine derivative, and about 2.0 percent by weight thiadiazole derivative.

3. A method for manufacturing a lubricant for service-free cardan shafts comprising the step of:

utilizing the composition of claim 2.

4. A method for manufacturing a lubricant for service-free cardan shafts comprising the steps of:

providing the composition of claim 2;

(i) at least one of dissolving and suspending the synthetic viscosity adjusting component in the base;

(ii) adding part of the additive to the synthetic viscosity adjusting component; and mixing (i) and (ii) together at an elevated temperature between about 80 degrees C and about 240 degrees C.

5. A lubricant for service-free cardan shafts comprising:

a base being about 86 percent by weight in the lubricant, having about 2.0 percent by weight boric acid, about 14.0 percent by weight monocarboxylic acids with 12 to 22 carbons or their glycerides, about 1.0 percent by weight polycarboxylic acid, about 3.0 percent by weight lithium hydroxide, and about 66.0 percent by weight paraffinic solvent raffinate;

a flux oil being about 7 percent by weight in the lubricant, having about 12.0 percent by weight olefin copolymer, about 36.0 percent by weight polyol ester, and about 52.0 percent by weight poly-α-olefin; and an additive component being about 7 percent by weight in the lubricant, having about 0.5 percent by weight amine antioxidant, about 0.5 percent by weight carboxylic acid alkanolamide, about 2.0 percent by weight molybdenum compound, about 1.0 percent by weight vegetable oil, about 1.0 percent by weight sarcosine derivative, and about 2.0 percent by weight thiadiazole derivative.

6. A method for manufacturing a lubricant for service-free cardan shafts comprising the step of:

utilizing the composition of claim 5.

7. A method for manufacturing a lubricant for service-free cardan shafts comprising the steps of:

providing the composition of claim 5, (i) at least one of dissolving and suspending the synthetic viscosity adjusting component in the base;

(ii) adding part of the additive to the synthetic viscosity adjusting component; and mixing (i) and (ii) together at an elevated temperature between about 80 degrees C and about 240 degrees C.

8. A lubricant composition comprising:

a base selected from the group consisting of a naphthenic solvent and a paraffinic solvent or mixture thereof;

a thickener selected from the group consisting of lithium soap, lithium salt, and amides of aromatic dicarboxylic acids;

at least one flux oil comprising hydrogenated diene-styrene copolymer; and an additive selected from the group consisting of molybdenum-, zinc- or bismuth dithiocarbamate and of a molybdenum-, zinc- or bismuth dithiophosphate in combination with a thiadiazole.

9. The lubricant of claim 8 wherein the thickener is a lithium salt, the lithium salt being a salt selected from the group consisting of salts of aliphatic saturated or unsaturated, mono- or di-carboxylic acid having 10 to 24 carbon atoms and cycloaliphatic or aromatic, mono- or di-carboxylic acids, or a mixture of the lithium salt of 12-hydroxystearic acid with lithium salts of azelaic acid, sebaic acid or boric acid, are complex lithium soaps formed from mixtures of various fatty acids and other acids.

10. The lubricant of claim 8 wherein the naphthenic solvent is a naphthenic solvent raffinate.

11. The lubricant of claim 8 wherein the total amount of additives is in the range of 2 to 10 percent by weight, based on the total lubricant.

12. The lubricant of claim 8, wherein the flux oil is about 2 to about 40 percent by weight, based on the total amount of the lubricant.

13. The lubricant of claim 12 wherein the lithium salt is about 5 to about 20 percent by weight, based on the amount of the base.

14. The lubricant of clair 13 further comprising an additive selected from the group consisting of amine antioxidants and phenolic antioxidants.

15. The lubricant of claim 8, further comprising a corrosion inhibitor N-acylsarcosine.

16. The lubricant of claim 8, wherein the additive is selected from the group consisting of molybdenum dithiophosphate with 1-thia-3,4-diazole, molybdenum dithio carbamate with 1-thia-3,4-diazole, molybdenum dithiophosphate with sulfur-bridged dimers of 1-thia-3,4-diazole, and molybdenum dithiocarbamate with sulfur-bridged dimers of 1-thia-3,4-diazole.

17. A method for lubricating cardan joints, comprising utilizing a lubricant for cardan joints, wherein the lubricant includes:

a) a base selected from the group consisting of a naphthenic solvent and a paraffinic solvent or a mixture thereof;

b) 5 to 20 percent by weight, calculated on the amount of the base, of a complex lithium soap consisting of a mixture of a saturated or an unsaturated, aliphatic mono- or di-carbonic acid with 10 to 24 carbon atoms and other acids;

c) 2 to 40 percent by weight, calculated on the total amount of the lubricant, of several flux oils selected from the group consisting of an olefin copolymer, a polybutene, a polyol ester, a poly-α-olefin, a perfluoropolyether, a polysiloxane and a hydrogenated diene-styrene copolymer; and d) a molybdenum dithiocarbamate or a molybdenum dithio phosphate in combination with a thiadiazole derivative, and at least one of conventional antioxidants, corrosion inhibitors and high-pressure additives.

18. The method of claim 17 wherein the lubricant includes at least one additive selected from the group consisting of an amine antioxidant and a phenolic antioxidant.

19. The method of claim 17, wherein the lubricant includes an additive N-acylsarcosine configured useable as a corrosion inhibitor.

20. The method of claim 18, wherein the lubricant includes additive N-acylsarcosine as a corrosion inhibitor.

21. A lubricant composition comprising:

a base including at least one of a mineral oil and a synthetic hydrocarbon oil;

a thickener selected from the group consisting of lithium soap, lithium salt, and amides of aromatic dicarboxylic acids;

at least one flux oil comprising hydrogenated diene-styrene copolymer; and an additive selected from the group consisting of molybdenum-, zinc- or bismuth dithiocarbamate and of a molybdenum-, zinc- or bismuth dithiophosphate in combination with a thiadiazole.

22. The lubricant of claim 21, wherein the at least one of a mineral oil and a synthetic hydrocarbon oil includes at least one of a naphthenic solvent, a paraffinic solvent, a naphthenic solvent raffinate, and a paraffinic solvent raffinate.

* * * * *